US007686627B2

(12) United States Patent
Wu et al.

(10) Patent No.: US 7,686,627 B2
(45) Date of Patent: Mar. 30, 2010

(54) RAIL-TYPE GROUNDING TERMINAL STRUCTURE HAVING A SPRING LATCH

(75) Inventors: Chih-Yuan Wu, Xinzhuang (TW); Biao-Huang Hsu, Xinzhuang (TW); Chien-Hsin Lee, Xinzhuang (TW)

(73) Assignee: Switchlab Inc., Taipei County (TW)

( * ) Notice: Subject to any disclaimer, the term of this patent is extended or adjusted under 35 U.S.C. 154(b) by 0 days.

(21) Appl. No.: 12/318,175

(22) Filed: Dec. 23, 2008

(65) Prior Publication Data

US 2009/0176388 A1 Jul. 9, 2009

(30) Foreign Application Priority Data

Jan. 4, 2008 (TW) ..... 97100482 A

(51) Int. Cl.
*H01R 13/648* (2006.01)

(52) U.S. Cl. ..... 439/95

(58) Field of Classification Search ..... 439/92–95, 439/532, 716, 717; 361/735, 810
See application file for complete search history.

(56) References Cited

U.S. PATENT DOCUMENTS 4,269,471 A * 5/1981 Woertz ..... 439/94
5,022,873 A * 6/1991 Kollmann ..... 439/716
5,362,259 A * 11/1994 Bolliger ..... 439/716
5,480,310 A * 1/1996 Baum ..... 439/94
5,704,805 A * 1/1998 Douty et al. ..... 439/532
5,797,756 A * 8/1998 Nad ..... 439/94
6,431,909 B1 * 8/2002 Nolden et al. ..... 439/532

* cited by examiner

*Primary Examiner*—Chandrika Prasad
(74) *Attorney, Agent, or Firm*—Rosenberg, Klein & Lee

(57) ABSTRACT

A rail-type grounding terminal structure composed of a metal grounding member and an insulating housing. The grounding member has better operation elasticity and can be easily tightly connected with a grounding rail. The grounding member includes a metal insertion leg mountable on a leaf spring mount, a bow section connected with the metal insertion leg and a first end and a second end respectively outward extending from the bow section and latched on a grounding rail. The metal insertion leg has a slightly outward deflected head end and a neck wall formed thereunder. When the metal insertion leg is mounted on the leaf spring mount, the leaf spring mount exerts a reaction force to urge the grounding member to tightly attach to lower side of the housing. Therefore, a gap is defined between the grounding member and the housing for a serviceman to separate the grounding member from the rail or connect the grounding member with the rail.

6 Claims, 7 Drawing Sheets

RAIL-TYPE GROUNDING TERMINAL STRUCTURE HAVING A SPRING LATCH

BACKGROUND OF THE INVENTION

The present invention is related to a rail-type grounding terminal structure composed of a metal grounding member and an insulating housing. The grounding member has better operation elasticity and a gap is defined between the grounding member and the insulating housing to provide an operation space.

A conventional metal grounding terminal is enclosed in an insulating housing (generally made of plastic material). A row of such grounding terminals is latched on a grounding rail (or conductive rail) to establish a common grounding device for electric appliances or power mechanical equipments. The grounding device serves to conduct and remove the current, static or instantaneous electric shock remaining in the machines or equipments. For example, U.S. Pat. No. 5,362,259 discloses a typical ground conductor terminal.

The ground conductor terminal includes an insulating housing in which a leaf spring mount or a conductive board is installed. The leaf spring mount or conductive board has multiple wire connectors for connecting with the grounding wires coming from the machines or equipments. A metal grounding member is connected on the leaf spring mount or conductive board by means of welding or riveting. The metal grounding member has two ends latched on the grounding rail (or conductive rail).

In the case that the ground conductor terminal needs to be replaced due to loosening, short-circuit, overheating, burnout or the like, an operator can use a tool (such as a screwdriver) to hook and pull a hook-shaped foot section formed on lower side of the insulating housing. At this time, the foot section urges one end of the grounding member to bias outward so as to unlatch the grounding member from the rail.

However, it often takes place that when the operator uses the tool to pull the foot section, simply the foot section is pulled, while the end of the metal grounding member is not truly pulled and unlatched from the rail at the same time. Under such circumstance, the ground conductor terminal is not separated from the rail and the operator needs to repeatedly pull the ground conductor terminal until it is separated from the rail. In some cases, the ground conductor terminal is very hard to detach from the rail even though a great pulling force is applied to the ground conductor terminal. This is because the insulating housing is generally made of plastic material and the grounding member is fixedly welded or riveted on the leaf spring mount. Therefore, when the insulating housing is biased and deformed, the metal grounding member can be hardly truly pulled and unlatched from the rail. Accordingly, it is quite troublesome and difficult for a serviceman to detach the ground conductor terminal from the rail.

In this field, it is required to tightly latch the metal grounding member with the rail so as to reduce resistance. In other words, it is a dilemma to on one hand make the metal grounding member tightly latched with the rail and on the other hand allow a serviceman to easily detach the ground conductor terminal from the rail.

SUMMARY OF THE INVENTION

It is therefore a primary object of the present invention to provide a rail-type grounding terminal structure composed of a metal grounding member and an insulating housing. The grounding member has better operation elasticity and can be easily tightly connected with a grounding rail. The grounding member includes a metal insertion leg and a bow section connected with the metal insertion leg. The bow section has a first end and a second end. The first and second ends outward extend and are latched on the grounding rail. The metal insertion leg has a slightly outward deflected head end and a slightly inward recessed neck wall formed under the head end. The metal insertion leg can be mounted on a leaf spring mount. The leaf spring mount will exert an action force onto the metal insertion leg to make the metal insertion leg tightly attach to lower side of the housing. Accordingly, a gap is defined between the grounding member and the housing to provide an operation space for a serviceman to separate the grounding terminal from the rail or connect the grounding terminal with the rail.

It is a further object of the present invention to provide the above rail-type grounding terminal structure in which the first end of the grounding member has a bending section. The bending section defines a groove. The groove has an inner wall face inclined to a horizontal reference line of the grounding member. When an operator operates the grounding member to derail from the rail, the rail will exert a reaction force onto the wall of the groove to push the first end and make the first end loosened from the rail.

It is still a further object of the present invention to provide the above rail-type grounding terminal structure in which each of the first and second ends has a bending section. The bending section has a bight section. When an operator operates the grounding member to derail from the rail, the bight section serves as a fulcrum.

It is still a further object of the present invention to provide the above rail-type grounding terminal structure in which the bow section of the grounding member provides a longer length or distance, whereby the grounding member has greater movement elasticity (or deformation range).

The present invention can be best understood through the following description and accompanying drawings wherein:

DETAILED DESCRIPTION OF THE PREFERRED EMBODIMENTS

Figure 1:
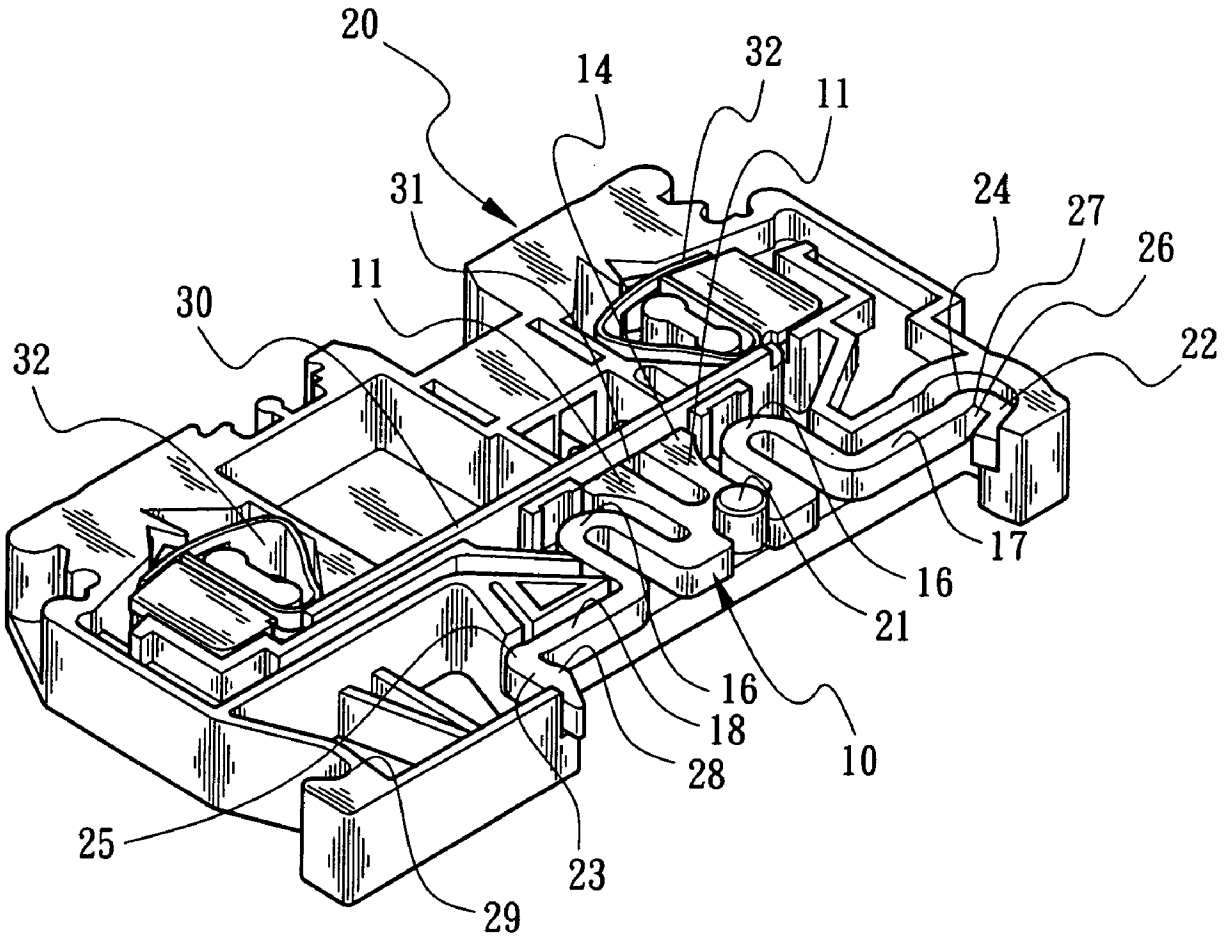
FIG. 1 is a perspective assembled view of the rail-type grounding terminal structure of the present invention, in which the insulating housing is sectioned to show internal structure thereof.
Figure 2:
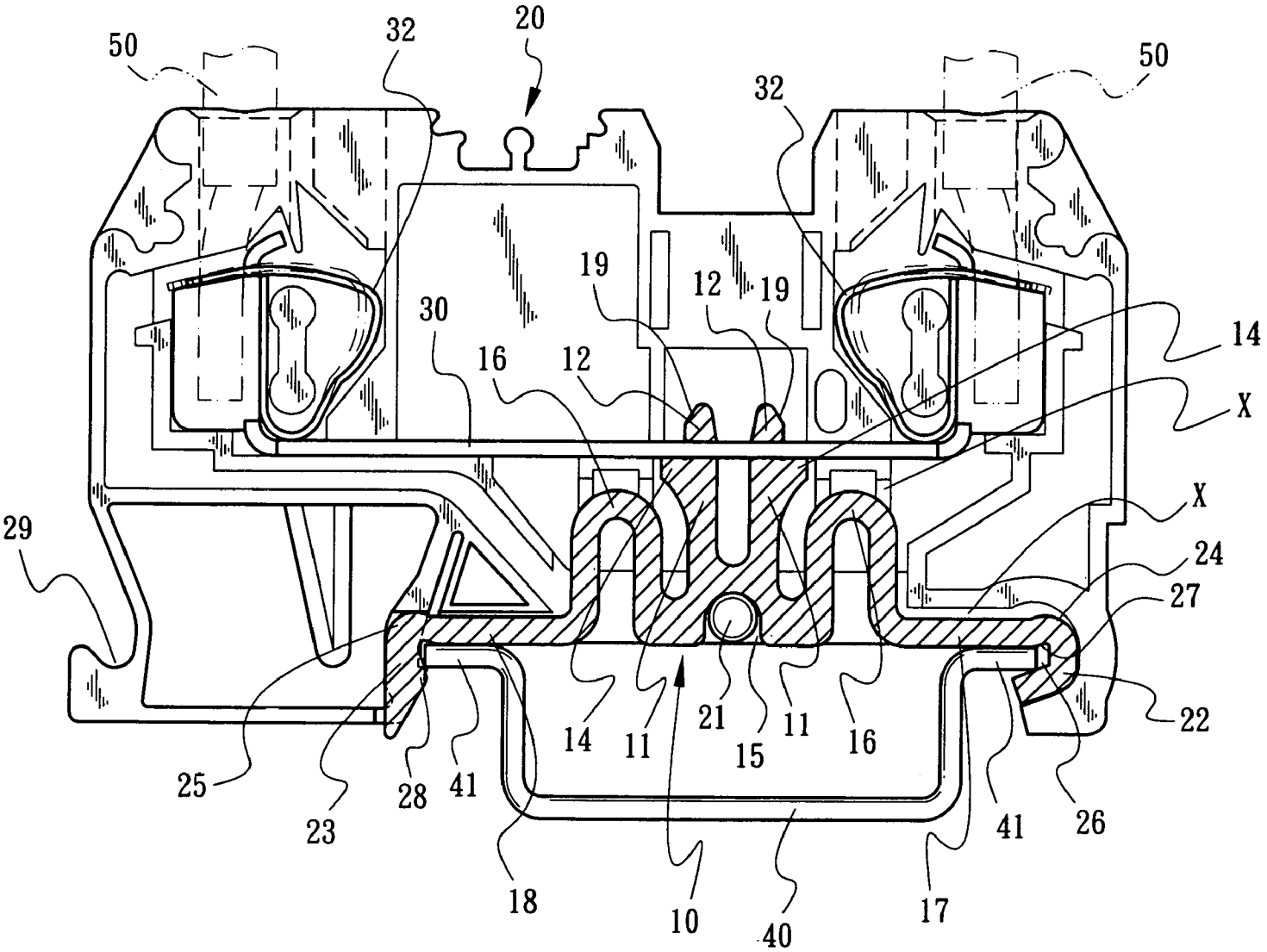
FIG. 2 is a sectional assembled view of the rail-type grounding terminal structure of the present invention.

Please refer to FIGS. 1 and 2. The rail-type grounding terminal structure of the present invention is composed of a metal grounding member 10 and an insulating housing 20. FIGS. 1 and 2 show an internal structure of the insulating housing 20. The insulating housing 20 is generally made of plastic material. A leaf spring mount (or conductive board) 30 is installed in the housing 20. The leaf spring mount 30 is formed with a hole 31 and multiple wire connectors 32 for connecting with grounding wires 50 coming from a machine or an equipment. The grounding member 10 is installed on the leaf spring mount 30. A first end 17 and a second end 18 of the grounding member 10 are latched on a grounding rail 40 (or a conductive rail) to together form a grounding device.

Figure 3:
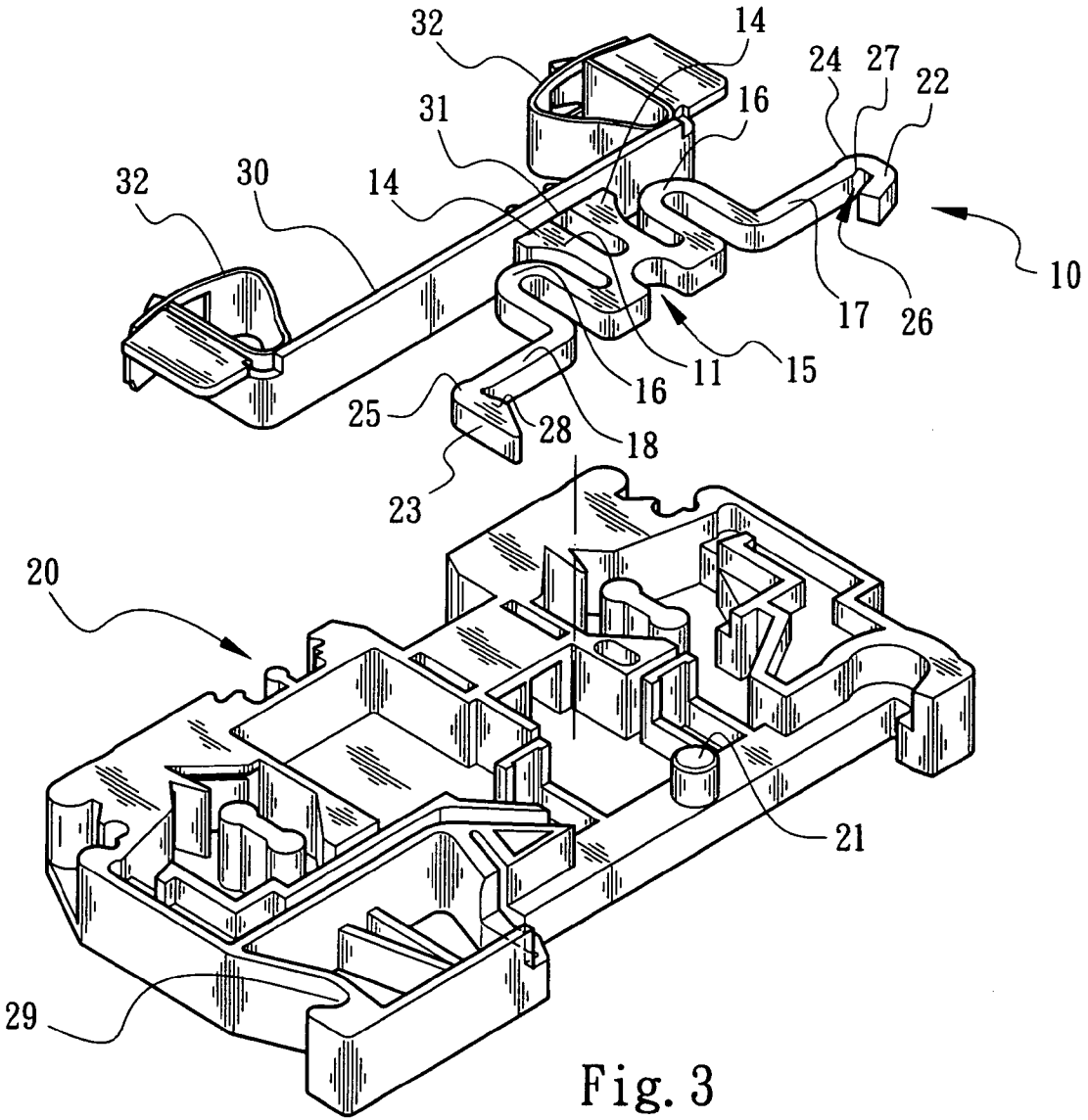
FIG. 3 is a perspective exploded view according to FIG. 1, showing the insulating housing, the grounding member and the leaf spring mount of the present invention.
Figure 4:
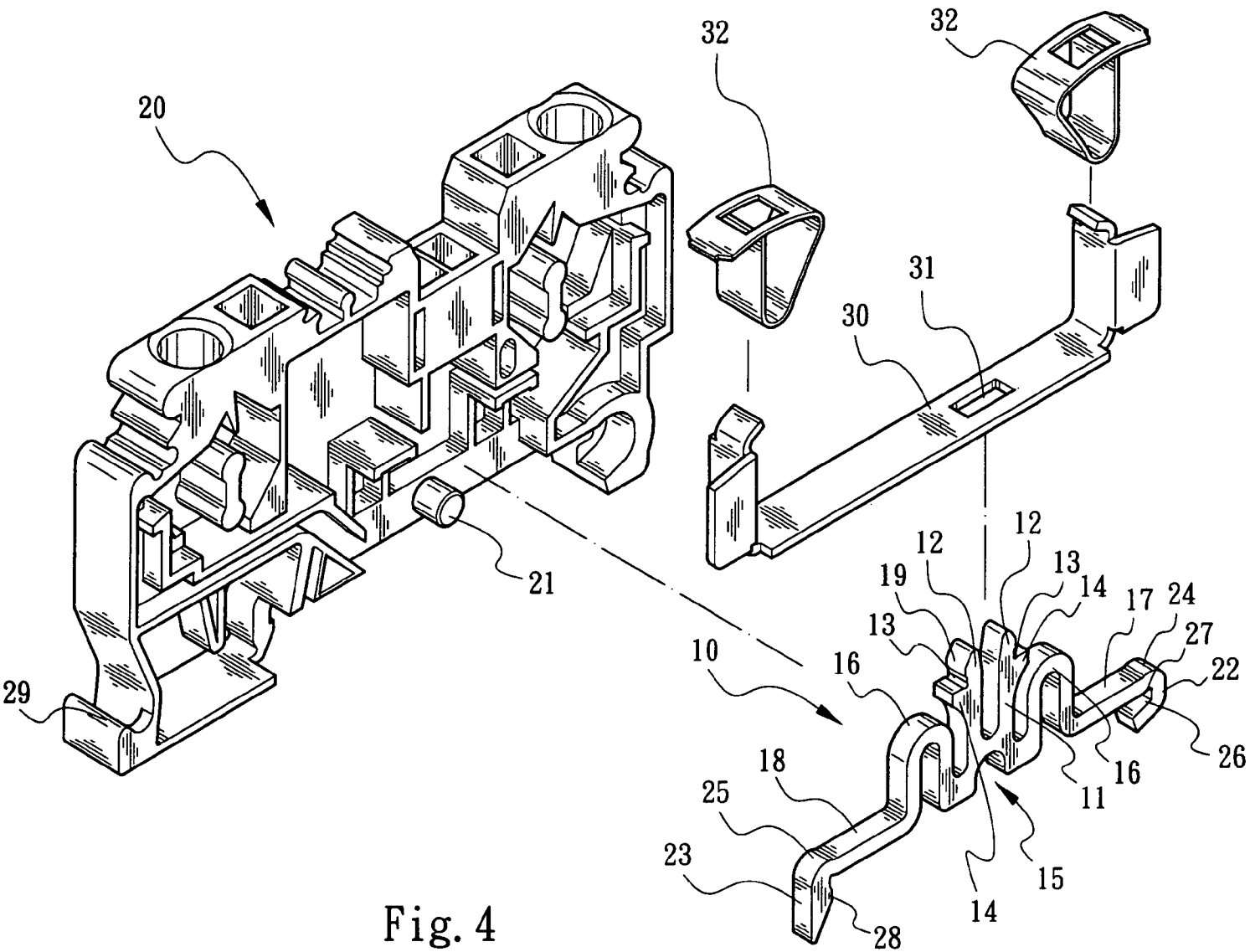
FIG. 4 is a perspective exploded view of the rail-type grounding terminal structure of the present invention.

Referring to FIGS. 3 and 4, the grounding member 10 is a substantially plate-shaped or bar-shaped member including a pair of metal insertion legs 11. In a preferred embodiment, each metal insertion leg 11 has a head end 12 slightly outward deflected about a central reference axis of the metal insertion leg 11. The metal insertion leg 11 further has a neck wall 13 slightly inward recessed toward the central reference axis and formed under an outer side of the head end 12. The metal insertion leg 11 can be easily manually pressed and mounted on a leaf spring mount 30. The leaf spring mount 30 will exert an action force onto the metal insertion leg 11 to make the metal insertion leg 11 tightly attach to lower side of the insulating housing 20. Accordingly, a gap X is defined between the grounding member 10 and the housing 20 to provide an operation space for a serviceman to separate the grounding terminal from the rail 40 or connect the grounding terminal with the rail 40. (This will be further described hereinafter.)

In this embodiment, the outer side of the head end 12 is formed with a slope 19 to facilitate insertion of the metal insertion leg 11 into a hole 31 of the leaf spring mount 30. An outward protruding shoulder section 14 is formed under the neck wall 13. When the metal insertion leg 11 is inserted into the hole 31 of the leaf spring mount 30, the shoulder section 14 abuts against a lower face of the leaf spring mount 30 with the neck wall 13 snugly engaged in the hole 31 as shown in FIG. 3.

The grounding member 10 has a recess 15 defined under the metal insertion legs 11. A post 21 of the insulating housing 20 can be fitted in the recess 15 as a support section for the grounding member 10 as shown in FIG. 1. The post 21 serves to support the grounding member 10 when the grounding member 10 is micro-moved. Preferably, the grounding member 10 has a pair of bow sections 16 connected with the metal insertion legs 11. Each bow section 16 provides a length or distance longer than that of the conventional grounding member, whereby the grounding member 10 has greater movement elasticity (or deformation).

The first end 17 and the second end 18 of the grounding member 10 respectively outward extend from the bow sections 16. The first and second ends 17, 18 respectively have bending sections 22, 23 respectively latching on the grounding rail 40. The bending section 22 of the first end 17 defines a groove 26. The groove 26 has an inner wall face 27 inclined to a horizontal reference line of the grounding member 10. When an operator operates and derails the grounding member 10 from the rail 40, a reaction force is created to push the first end 17 and loosen the first end 17 from the rail 40. The bending section 23 of the second end 18 is formed with a tongue section 28. The tongue section 28 and the groove 26 of the first end 17 cooperate to fix and fasten the grounding member 10 on the rail 40.

Figure 5:
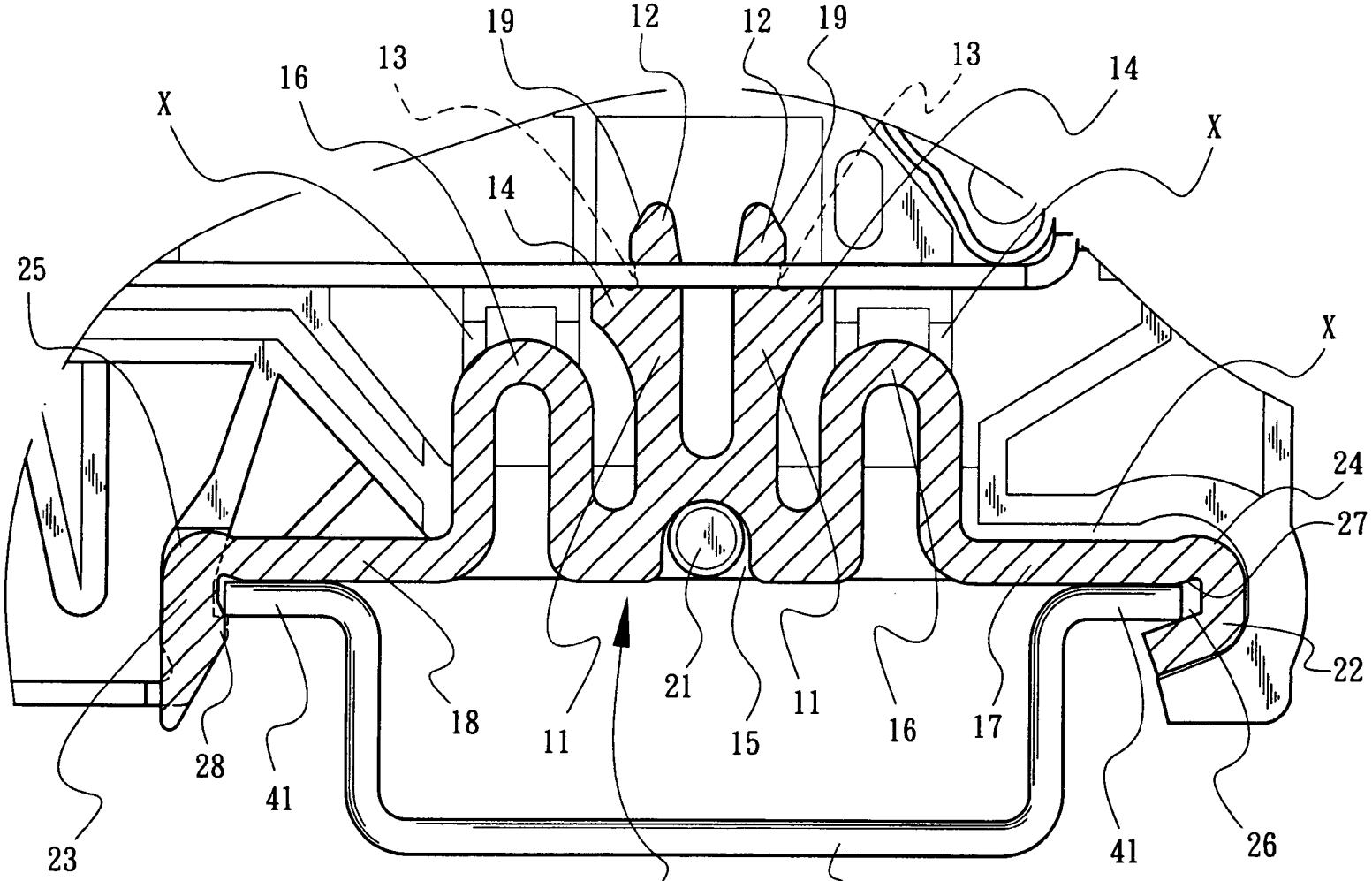
FIG. 5 is an enlarged view of a part of FIG. 2.
Figure 6:
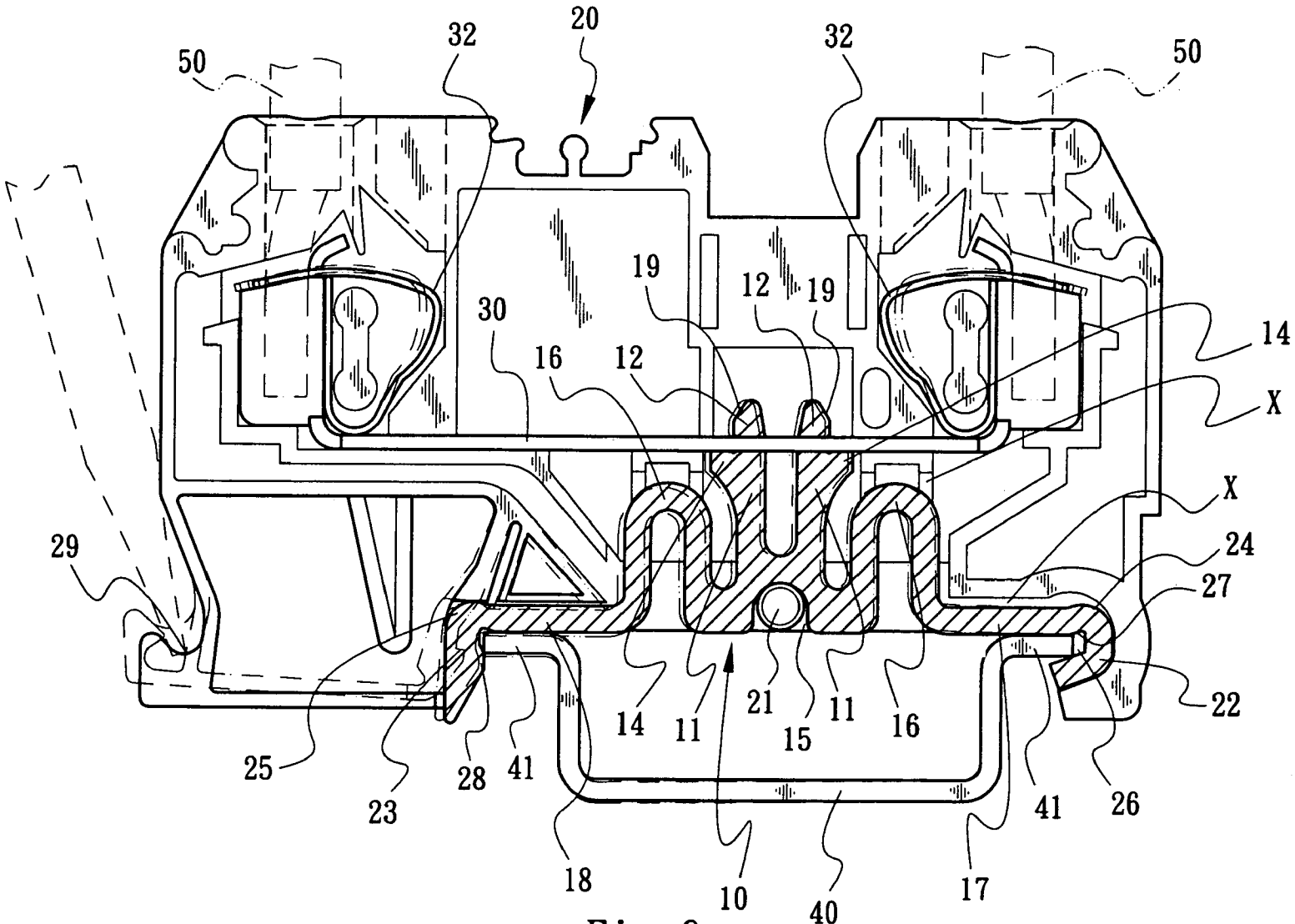
FIG. 6 is a sectional view according to FIG. 2, showing the operation of the present invention.

Referring to FIGS. 5 and 6, an operator can use a tool 70 (such as a screwdriver) to outward (leftward according to FIG. 9) pry a lower foot section 29 of the insulating housing 20 and pull the housing 20. At this time, the housing 20 will drive the grounding member 10 to deflect leftward. Under such circumstance, the tongue section 28 of the binding section 23 of the second end is micro-lifted by the tool 60 to unlatch and loosen from the rail 40 as shown by phantom line of FIG. 6.

Figure 8:
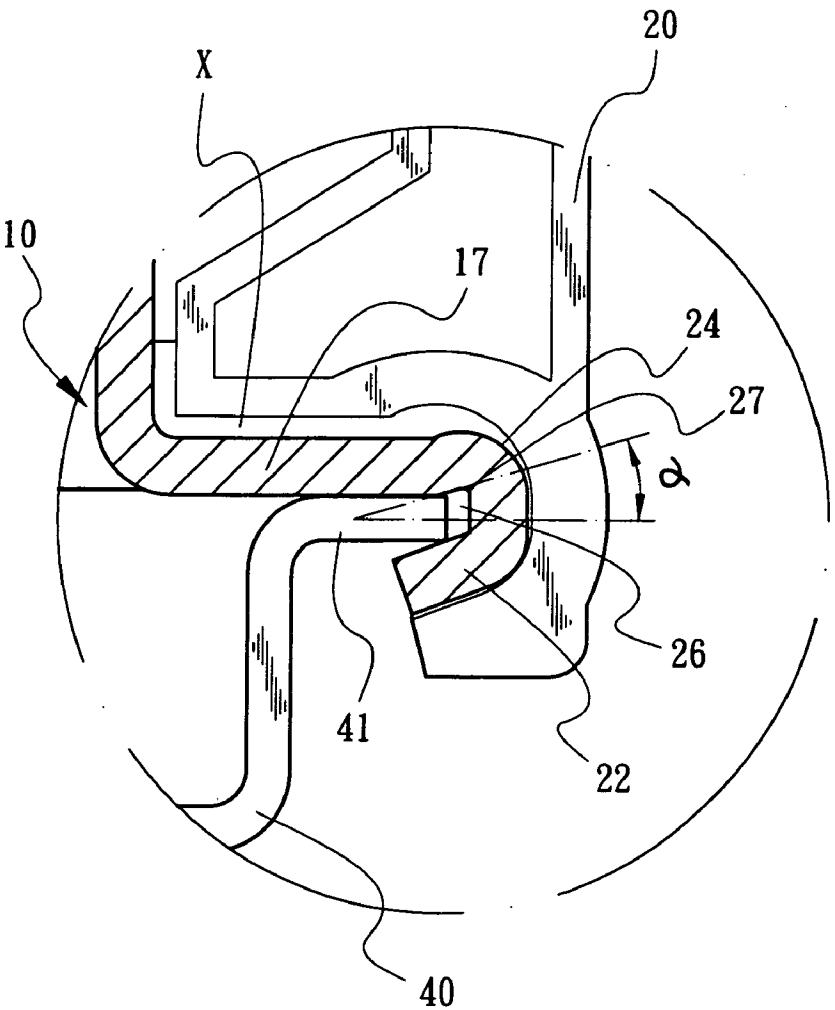
FIG. 8 is a view according to FIG. 7, showing the operation of the present invention.
Figure 7:
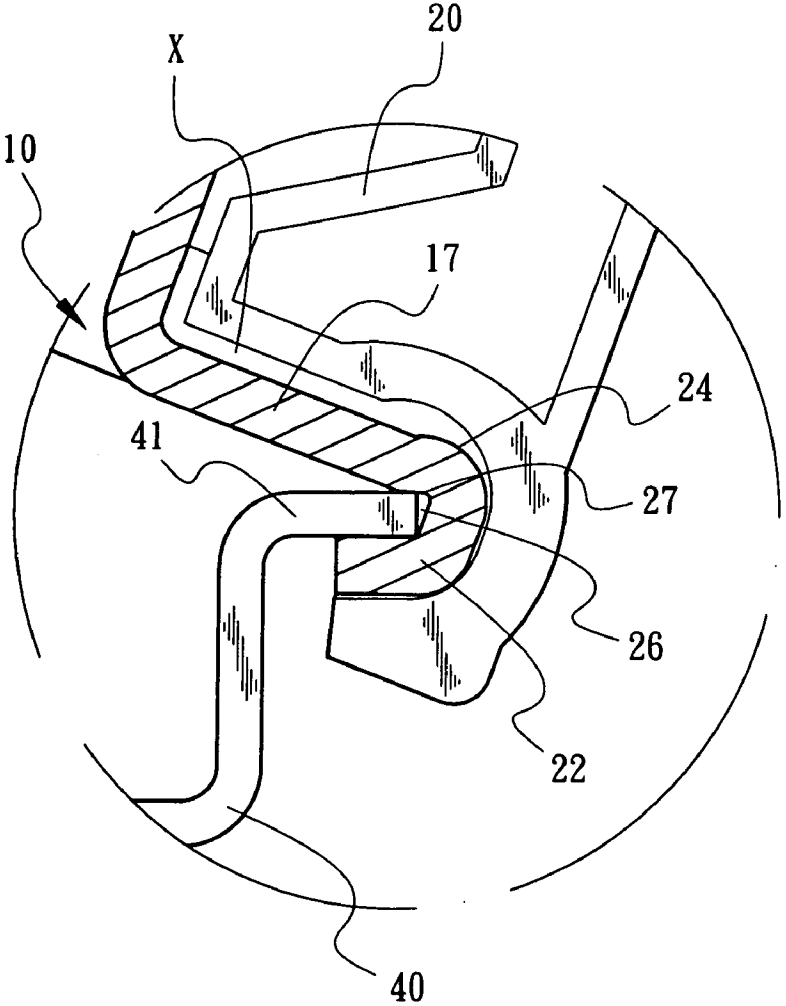
FIG. 7 is an enlarged view showing the first end of the grounding member is assembled with the rail.

It should be noted that according to the above arrangement, the grounding member 10 can be tightly latched with the rail 40 to remove the remaining current, static or instantaneous electric shock. Moreover, a serviceman can easily unlatch the grounding member 10 from the rail 40. The present invention has the following advantages:

1. As aforesaid, a gap X is defined between the grounding member 10 and the housing 20. When the head ends 12 of the metal insertion legs 11 are forcedly inserted into the hole 31 of the leaf spring mount 30, the leaf spring mount 30 will exert a reaction force onto the grounding member 10 to urge the grounding member 10 to move toward lower side of the insulating housing 20. Therefore, the grounding member 10 will attach to the lower side of the housing 20 as snugly as possible. Accordingly, a gap X is defined between upper side of the grounding member 10 and the housing 20. The gap provides an operation space for a serviceman to separate the grounding member 10 from the rail 40 or connect the grounding member 10 with the rail 40.
2. As shown in FIGS. 7 and 8, the bending section 22 of the first end 17 defines the groove 26. The groove 26 and the inner wall face 27 thereof are inclined to the horizontal reference line of the grounding member 10. When the first end 17 of the grounding member is tightly latched on the rail 40, the groove 26 and the rail bracket 41 contain an angle $\alpha$. When an operator pries the second end 18 of the grounding member to derail the grounding member 10 from the rail 40, the rail bracket 41 will exert a reaction force onto the wall of the groove 26 to bound away the grounding member 10. This is for making the groove 26 and the rail bracket 41 positioned on the same reference line'so as to compensate the angle $\alpha$. As a result, the first end 17 is pushed to loosen from the rail 40 as shown in FIG. 8. It should be noted that this reaction force also helps the serviceman to more easily unlatch the grounding member 10 from the rail 40.
3. In a preferred embodiment, the bending sections 22, 23 of the first and second ends 17, 18 respectively have two bight sections 24, 25. When an operator operates to derail the grounding member 10 from the rail 40, the bight sections 24, 25 serve as fulcrums.

In conclusion, the rail-type grounding terminal structure of the present invention has better operation flexibility. In addition, the grounding member can be easily tightly latched with the rail 40 or unlatched therefrom. The present invention overcomes the dilemma existing in the prior art that the metal grounding member must be tightly latched with the rail on one hand and must allow a serviceman to easily detach the grounding terminal from the rail on the other hand.

The above embodiments are only used to illustrate the present invention, not intended to limit the scope thereof. Many modifications of the above embodiments can be made without departing from the spirit of the present invention.

What is claimed is:

1. A rail-type grounding terminal structure for releasable coupling to opposing flanges of a grounding rail, comprising:

an insulating housing having a plurality of receiving spaces formed therein and a foot section formed on a lower portion of one end of the insulating housing;

a leaf spring mounting member disposed in a first of the plurality of receiving spaces;

a plurality of wire connecting members respectively disposed in a plurality of second receiving spaces and being electrically coupled to the leaf spring mounting member; and a grounding member disposed below the leaf spring mounting member in a third receiving space located adjacent a bottom side of the insulating housing and electrically coupled to the leaf spring mounting member, the grounding member including:

a pair of spaced apart insertion legs engaged with the leaf spring mounting member, each leg having a slightly outward deflected head end passing through an opening formed through the leaf spring mounting member;

a pair of bow sections extending upwardly in a direction toward the leaf spring mounting member and respectively disposed intermediate a corresponding one of the pair of insertion legs and respective opposing end portions of the grounding member to provide for elastic deformation of the end portions;

a a first bent section having a hook-shaped contour formed on one of the end portions, the hook-shaped bent section defining a groove into which a respective one of the flanges of the grounding rail is engaged, the groove having an inclined inner wall face corresponding to a distal end portion of the hook-shaped bent section to provide for pivotal displacement of the grounding member and the insulating housing therewith relative to the grounding rail; and a second bent section formed on the opposing end portion, the second bent section having a protruding tongue section formed thereon for latchingly engaging the opposing flange of the grounding rail, wherein the tongue portion is displaced out of engagement with the opposing flange of the grounding rail by a respective portion of the insulating housing responsive to a corresponding displacement of the foot section using a tool engaged therewith.

2. The rail-type grounding terminal structure as claimed in claim 1, wherein the grounding member is a substantially plate-shaped or bar-shaped member.

3. The rail-type grounding terminal structure as claimed in claim 1, wherein each insertion leg further has a neck wall, the neck wall being slightly inward recessed toward a central reference axis of the grounding member and formed under an outer side of the head end of the insertion leg, the neck wall being engaged with an edge of the opening in the leaf spring mounting member.

4. The rail-type grounding terminal structure as claimed in claim 3, wherein an outer side of the head end is formed with a slope.

5. The rail-type grounding terminal structure as claimed in claim 3, wherein an outward protruding shoulder section is formed under the neck wall.

6. The rail-type grounding terminal structure as claimed in claim 1, wherein the insulating housing has a post formed adjacent the bottom side thereof and the grounding member has a recess formed on a bottom side thereof for receiving the post therein to support the grounding member thereon.

* * * * *